US009118149B2

(12) United States Patent
Kappla et al.

(10) Patent No.: US 9,118,149 B2
(45) Date of Patent: Aug. 25, 2015

(54) CONNECTOR ELEMENT

(71) Applicant: LEONI KABEL HOLDING GMBH, Nuremberg (DE)

(72) Inventors: Olaf Kappla, Munich (DE); Andreas Joseph Schmid, Gruenwald (DE); Katja Schoeber, Baldham (DE); Christoph Untiedt, Klein Berssen (DE); Arno Frahmann, Altenoythe (DE)

(73) Assignee: Leoni Kabel Holding GmbH, Nuremberg (DE)

( * ) Notice: Subject to any disclaimer, the term of this patent is extended or adjusted under 35 U.S.C. 154(b) by 0 days.

(21) Appl. No.: 14/190,322

(22) Filed: Feb. 26, 2014

(65) Prior Publication Data

US 2014/0179143 A1 Jun. 26, 2014

Related U.S. Application Data

(63) Continuation of application No. PCT/EP2012/066455, filed on Aug. 23, 2012.

(30) Foreign Application Priority Data

Aug. 26, 2011 (DE) ..... 10 2011 111 280
Dec. 9, 2011 (DE) ..... 10 2011 088 124

(51) Int. Cl.
*H01R 13/633* (2006.01)
*H01R 13/627* (2006.01)
*H01R 13/66* (2006.01)

(52) U.S. Cl.
CPC ..... *H01R 13/6335* (2013.01); *H01R 13/6275* (2013.01); *H01R 13/665* (2013.01)

(58) Field of Classification Search
CPC ..... H01R 13/6272; H01R 13/6275; H01R 13/641; H01R 13/6273
See application file for complete search history.

(56) References Cited

U.S. PATENT DOCUMENTS 5,564,939 A * 10/1996 Maitani et al. ..... 439/352
8,388,367 B2 * 3/2013 Nonen et al. ..... 439/358

(Continued)

FOREIGN PATENT DOCUMENTS

CN 201741940 U 2/2011
CN 101989713 A 3/2011

(Continued)

OTHER PUBLICATIONS

International Search Report of PCT/EP2012/066455, Dated Apr. 5, 2013.

*Primary Examiner* — Gary Paumen
(74) *Attorney, Agent, or Firm* — Laurence A. Greenberg; Werner H. Stemer; Ralph E. Locher

(57) ABSTRACT

A connector element is configured in a manner of a flat connector and has a two-part connector housing extending in the longitudinal direction and a locking mechanism for forming a lockable plug-in connection with a counterpart. The locking mechanism contains a locking element having a pull tab fastened thereto. In order to enable a reliable emergency release even if the pull tab is ripped off, the locking element is led outside by a mounting part and the pull tab is irremovably fastened to the mounting part by riveting the pull tab or injection molding the pull tab onto the mounting part. This also makes it possible to easily adapt the pull element in a customer-specific manner.

15 Claims, 6 Drawing Sheets

(56) References Cited

U.S. PATENT DOCUMENTS

| | | | | |
|---|---|---|---|---|
| 8,444,430 | B2 | 5/2013 | Kappla et al. | |
| 8,475,197 | B2 * | 7/2013 | Zerebilov et al. | 439/352 |
| 8,545,252 | B2 | 10/2013 | Wang et al. | |
| 8,556,646 | B2 | 10/2013 | Kappla et al. | |
| 8,599,567 | B2 | 12/2013 | Wu | |
| 2002/0150343 | A1 | 10/2002 | Chiu et al. | |
| 2011/0081114 | A1 | 4/2011 | Togami et al. | |
| 2011/0304996 | A1 | 12/2011 | Wu | |
| 2012/0220147 | A1 | 8/2012 | Wang et al. | |

FOREIGN PATENT DOCUMENTS

| | | | |
|---|---|---|---|
| CN | 202076595 | U | 12/2011 |
| WO | 2011072869 | A1 | 6/2011 |
| WO | 2011089003 | A1 | 7/2011 |

* cited by examiner

CONNECTOR ELEMENT

CROSS-REFERENCE TO RELATED APPLICATION

This is a continuation application, under 35 U.S.C. §120, of copending international application No. PCT/EP2012/066455, filed Aug. 23, 2012, which designated the United States; this application also claims the priority, under 35 U.S.C. §119, of German patent application No. DE 10 2011 111 280.8, filed Aug. 26, 2011; and of German patent application No. DE 10 2011 088 124.7, filed Dec. 9, 2011 the prior applications are herewith incorporated by reference in their entireties.

BACKGROUND OF THE INVENTION

Field of the Invention

The invention relates to a connector element.

The connector element is a so-called flat connector having a locking mechanism, as is used as an electrical or optical connector in particular in computer networks. Such connector elements are also known as small form factor pluggable (SFP) or quad small form factor pluggable (QSFP) and have their geometrical dimensions determined in appropriate standards. International patent disclosure WO 2011/089003 A1 (corresponding to U.S. Pat. No. 8,556,646) discloses such a QSFP connector. Furthermore, international patent disclosure WO 2011/072869 A1 (corresponding to U.S. Pat. No. 8,444,430) discloses an SFP connector element (also referred to as a CXP connector element).

The QSFP connector is distinguished, in principle, by an unlocking mechanism which is integrated in the side walls of the housing. Provided for this purpose is an approximately bracket-form locking element which is guided internally, in the rear region of the connector housing, between two housing halves. Accordingly, the locking element has two locking arms, which extend in the longitudinal direction in the side walls and at the ends of which is arranged a respective catch element, which projects laterally beyond the locking arms.

In contrast to such QSFP connector types, the catch element in the SFP connector types is formed on an upper side of the connector housing. In the case of the SFP connector according to international patent disclosure WO 2011/072869 A1, the locking element as a whole is configured in the manner of a rocker, on which the catch element is formed in the front end.

An actuating element is usually provided to actuate the locking mechanism and, both by pulling or rotating, manually transfers the locking element from a locked position into an unlocked position. The known SFP or QSFP connectors from the two aforementioned documents each have a pull tab which is pulled in the longitudinal direction of the connector for unlocking purposes.

As already mentioned, such connectors serve for connecting in particular data cables in computer networks to equipment or else distributors. The amount of installation space here is often restricted and the individual connectors are arranged in a very close-packed manner one beside the other. Internally, the connectors have suitable electronics, usually integrated in a printed circuit board. The printed circuit board with appropriate contacts, at the same time, also forms a contact tab, which has its end side freely accessible at the front end of the connector housing and via which a plug-in contact with the respective component is formed. The connectors are generally configured for repeated unlocking and locking.

SUMMARY OF THE INVENTION

Proceeding herefrom, it is an object of the invention to configure such a connector element for permanently reliable, reversible locking and unlocking.

The connector element has a locking mechanism for forming a lockable plug-in connection to a counterpart. For this purpose, it has a connector housing, which extends in the longitudinal direction and has two housing parts, namely an upper part and a lower part. The connector housing extends from a rear end wall with a cable opening for a cable which is to be connected, to a front end side, with an opening for a plug-in contact element. The connector housing here usually forms a housing step, which separates a rear part from a front connector region, by way of which the connector is plugged into the counterpart (component). The step here is usually formed merely on the upper side, but possibly also on the underside. The plug-in contact element is the already described printed circuit board.

The locking mechanism has a longitudinally movable pull tab, which is arranged outside the housing and is connected in a rotationally fixed manner to a locking element arranged, at least in part, within the housing. The locking element, in turn, has a catch element which is intended for the form-fitting unlocking and locking of the connector element in relation to the counterpart. When the pull tab is subjected to pulling action (exclusively) in the longitudinal direction, the catch element can be transferred out of a locking position into an open position. Of particular importance, then, is the fact that the locking mechanism is of two-part configuration, that is to say, on the one hand, the locking element has a rear installation part, by which it is guided out of the housing via the rear end wall, and also has, as second part, the pull tab, which is fastened in a non-releasable manner on the rear installation part.

The at least two-part configuration makes it possible, on the one hand, to provide differently configured, client-specific pull tabs for example with client-specific printing or with client-specific designs, with the parts being otherwise identical. A further critical advantage can be seen in the fact that even if the pull tab, which usually consist of plastics material, is torn off, the installation parts arranged outside the housing can still be gripped by a tool in order to effect emergency unlocking of the connector. In the case of a single-piece configuration in particular made of plastics material, that is to say a configuration in which the pull tab and the unlocking element, which extends into the housing, are formed in one piece from a plastics material, there is the problem of tearing off occurring within the housing, in which case there is no possibility of release. The configuration selected here therefore renders emergency unlocking possible.

The pull tab here is riveted in particular to the installation part. In an alternative configuration, the pull tab is configured as a plastic part which is molded onto the installation part. For reliable connection, the installation part here preferably has form-fitting elements such as holes, undercuts, etc. The molding also achieves, overall, a very pleasing visual impression.

In the case of riveting, the rivets are preferably retained in captive fashion in the pull tab prior to the actual fastening on the installation part, and this makes easy installation possible.

The locking element with the installation part is preferably formed from metal and thus in particular from a material with a higher tensile strength than the pull tab made of plastics material. This ensures that, in the event of mechanical overloading, the pull tab tears outside the housing, rather than, for example, the locking element within the housing.

The pull tab preferably extends generally over a plane of an outer side of the housing, in which case therefore the pull tab is arranged on one side of the cable, which is fed to the connector via the rear end wall of the latter. According to a first variant, the pull tab here, as seen in a side view, is of approximately L-shaped design at least in the region in the vicinity of the housing and has two lateral vertical arms, which butt against the rear side of the housing and are fastened on corresponding respective installation legs of the installation part. The cable opening is located between the two opposite vertical arms. The vertical arms extend, in particular, over the entire height of the connector housing. A particular advantage of this configuration can be seen in the fact that the pull tab can be fastened optionally at the bottom or top, with the locking element being of identical design in each case. It is therefore generally provided, in a preferred configuration, that the pull tab can be installed in a state in which it is offset by rotation through 180° in relation to the longitudinal direction. According to a first variant, this takes place solely by the pull tab itself being installed differently; in a second variant, the pull tab can be rotated through 180° together with the locking element, no further modifications to the rest of the components of the connector having to be carried out. It is therefore possible in this case (QSFP) for the locking element to be installed together with the pull tab optionally in one orientation or the other (rotated through 180° about the longitudinal direction).

The installation part, in addition, preferably has a transverse bracket, on which the pull tab is fastened. The transverse bracket here forms, with the rest of the installation part, a monolithic part, for example a sheet-metal part which is formed by bending.

Rivets are used for example to fasten the pull tab on the transverse bracket. In an alternative configuration, the two L-shaped vertical arms are connected to one another via such a transverse bracket, which may also be arranged to run within the housing.

Such connector elements generally have very narrow tolerance limits predetermined for the housing dimensions, so that reliable locking is made possible. In order to ensure positionally accurate installation of the two housing parts, which are configured in the manner of two half-shells, a preferred development forms a play-free, step-like connection between the upper part and lower part in the front connector region of the connector housing. For this purpose, the upper part and lower part engage one inside the other to form a step and have, at the same time, corresponding installation slopes, which allow the two parts to pivot in relation to one another for installation purposes. Step-like formation here is understood to mean a form-fitting connection in the vertical direction perpendicular to the longitudinal direction, and therefore the position of the two housing halves in relation to one another is fixed in the vertical direction. The slope, which adjoins the step and is oriented, for example, at an angle between 30° and 60°, especially makes it possible for the two housing parts to be pivoted relative to one another, for installation purposes, about a pivot axis which runs perpendicularly to the longitudinal axis and parallel to a parting plane between the two shell-like housing parts.

The one of the two housing parts, in particular the upper part, expediently contains for this purpose, on the end side of each of its side walls, a nose, preferably with a rectangular side surface, which extends parallel to the longitudinal direction and is adjoined by the installation slope. The complementary lower part, accordingly, has a recess with an adjoining installation slope. Appropriate accurately dimensioned production achieves, overall, a play-free snug fit between the two parts.

In an expedient development, in particular in addition to the step-like connection, there is likewise a form-fitting connection of the housing parts formed in the rear region, and therefore the housing parts are meshed with one another in the longitudinal direction, so as to prevent horizontal displacement. The form fit thus acts in the longitudinal direction. The two housing parts are brought into the formfitting connection at the rear on account of the pivoting movement. During installation, first of all the upper part is introduced into the recess with the nose in front, and inclined at an angle in relation to the lower part, and is then pivoted in relation to the lower part. The two housing parts here engage one inside the other at the rear end in order to form the meshing.

In the case of the configuration as an SFP connector element, the locking element expediently has a rocker which can be tilted about a horizontal axis of rotation and has the catch element at its front end. A second rocking arm is provided in the rear region, behind the axis of rotation, and thus opposite to the catch element, the second rocking arm preferably being inclined obliquely and having the pull tab acting on it by way of a transverse strut in order for the rocker to be actuated.

As already explained above, there is a partial risk of the pull tab tearing off and thus of it no longer being possible for the connector to be unlocked. In order to solve this problem, a preferred configuration arranges, on the rocker, an actuating element, which projects beyond the upper side of the housing and is accessible to a tool such that emergency actuation of the rocker is rendered possible when the connector element has been plugged in place. In the simplest case, the tool is a pin-like element which is pushed against the actuating element in the longitudinal direction in order to tilt the rocker about the axis of rotation.

The rocker and the catch element are expediently configured such that the catch element, upon actuation of the rocker from a locking position into an unlocking position, is drawn in inward in the direction of a housing center. The catch element is thus drawn away from the counterpart (component) for the unlocking operation. The locking of the connector element usually takes place by way of a cage-like insert in a housing of the components, wherein the catch element here engages in a corresponding recess. In the case of conventional SFP connector variants, as described, for example, also in international patent disclosure WO 2011/072869 A1, the catch element engages in the corresponding recess in the counterpart housing from above and is drawn away upward for the unlocking position. The cage or the counterpart housing element is thus stored on an interim basis between an upper side of the connector housing, in the connector region, and the catch element. Tolerance-related problems in the production of such fastening cages, which are usually configured as parts formed by punching and bending, may result in unlocking-related problems on account of incomplete unlocking. The solution described here does away with this problem.

It is also the case, in a preferred configuration, that a spring element is arranged in the front region, the spring element subjecting the front part of the rocker with the catch element to a spring force in the vertical direction. The force is therefore directed perpendicularly to the axis of rotation of the rocker, the force therefore acting, as far as possible, at right angles. The spring element pushes the rocker outward into the locked position. The spring element here is, for example, a leaf spring or else a helical spring.

It is also the case that the rocker is preferably mounted in a rotatable manner on a rotary pin. The rocker and the rotary pin are therefore two separate parts which can be rotated relative to one another. This achieves mounting which has as low a level of friction as possible, as a result of which the spring force exerted by the spring element is realized as efficiently as possible for reliable locking.

In the case of the SFP connector element, the rocking mechanism is arranged in the rear sub-region of the connector housing. Accordingly, the rear sub-region is usually configured to be of somewhat higher construction. In an expedient configuration, the rear sub-region contains an accommodating chamber for the rocker, the accommodating chamber being closed in relation to the rest of the housing interior. This expediently takes place via a metallic shielding plate, which is fixed, for example riveted, to the housing. In particular also the rear rocking leg is supported on the lower boundary of the accommodating chamber, and this leg is therefore pressed into a defined basic position on account of the spring force which acts on the front region of the rocker.

Using the shield element also has particular advantages in terms of EMC, since a desired shielding action is achieved as a result. Fastening the shielding plate separately on the housing, furthermore, isolates the unlocking mechanism, that is to say the rocker function, completely from the rest of the components in the connector housing.

In the case of the connector element being configured as a QSFP connector, the locking element contains two longitudinally extending locking arms, which run laterally on, and preferably partially in, the side walls of the connector housing and each have, at the end, a catch element projecting outward perpendicularly to the longitudinal direction. The locking arms here are preferably configured as sheet-metal tabs which are connected to one another in the rear region via a transverse bracket. The transverse bracket is preferably part of the installation part, which is located outside the connector housing and on which the pull tab is fastened. As an alternative to the configuration with the transverse bracket, each of the sheet-metal tabs is guided individually rearward out of the housing and are connected to one another, only via the pull tab, outside the housing.

For reliable locking, a preferred configuration fastens a longitudinally extending spring, in particular helical spring, on each of the locking arms. The respective spring is therefore more or less part of the locking arm and is pre-installed on the same, which simplifies installation. Orientation in the longitudinal direction, in addition, achieves effective action of spring force into the basic position. The basic position here is a front position, in which the locking arm is pushed, in relation to the connector housing, in the direction of the front end side.

In respect of the captive fastening of the spring on the respective locking arm being of the simplest possible configuration as possible, the locking arms are each preferably configured as parts which are formed by punching and bending and have a punched-out portion with a sheet-metal tab bent out of the same. The spring is fixed on the bent-out sheet-metal tab. The spring is preferably clamped here, and therefore the sheet-metal tab is a clamping tab. The sheet-metal tab expediently contains a plurality of sub-tabs, which form a clamping mount for the spring in the manner of a cage.

In order to increase the stability of the connector housing—irrespective of the specific configuration as an SFP or QSFP connector—the one housing part, in particular the upper part, on its front end side, has a transverse bracket, which is angled in the direction of the lower part and also engages in the form-fitting manner around the lower part. This achieves a reliable form-fitting connection in the vertical direction perpendicular to the longitudinal direction. Engagement of the transverse bracket around the lower part achieves, overall, good guidance of the lower part in the upper part.

In order for the two housing parts to be connected reliably, the housing parts are also preferably fastened to one another via rivets. For this purpose, a rivet guide is formed within the housing parts, the rivet guide extending through the housing wall and preferably guiding the rivet over its entire length.

In order to form a rivet guide which is as accurate and free of play as possible, and at the same time allow easy installation, the rivet guide has the smallest diameter formed at its two opposite ends. The rivet guide, overall, is therefore curved for example convexly in its central region. As an alternative, it is also possible for the rivet guide to taper conically at each of its ends.

The above described configuration of the housing parts with the longitudinally form-fitting connections between the two housing parts both in the front and in the rear regions makes it possible for the rivet connection to be reliably relieved of loading in the longitudinal direction, and therefore the rivet connection has to hold the two housing parts together merely in its longitudinal direction, that is to say in the vertical direction (perpendicular to the longitudinal direction of the connector housing).

As already mentioned, within the connector housing, the actual connector electronics are fitted, in particular, on a printed circuit board. In a preferred embodiment, the printed circuit board is fixed in a play-free manner, and also clamped, preferably by peripheral protuberances. The protuberances here are arranged opposite one another on a respective housing part. The protuberances preferably are arranged both in the upper part and in the lower part.

The sum of features described here forms, overall, a flat connector which is particularly suitable for any emergency unlocking which may be necessary and which, at the same time, displays a reliable mechanical connection between the housing halves and also has an effectively acting locking mechanism, via spring elements, which retain the catch elements in each case reliably and reversibly in the locking positions.

The individual aspects described here give rise, in particular in combination, to an advantageous combined effect so as to form a product which is marketable in all respects. A large number of the aspects, however, may also be realized independently of the features characterizing the main claim, that is to say of the two-part design between the pull tab and locking element. This applies, in particular, to the following features, and combinations of features, which are considered to be inventive in their own right without this two-part configuration between the locking element and pull tab.

Other features which are considered as characteristic for the invention are set forth in the appended claims.

Although the invention is illustrated and described herein as embodied in a connector element, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 5A is a diagrammatic, perspective view of the QSFP connector element with the pull tab molded on;

FIG. 9 is a perspective view, from an inside, of the upper part of the housing of the SFP connector element with a shielding plate riveted on;

DETAILED DESCRIPTION OF THE INVENTION

Figure 1:
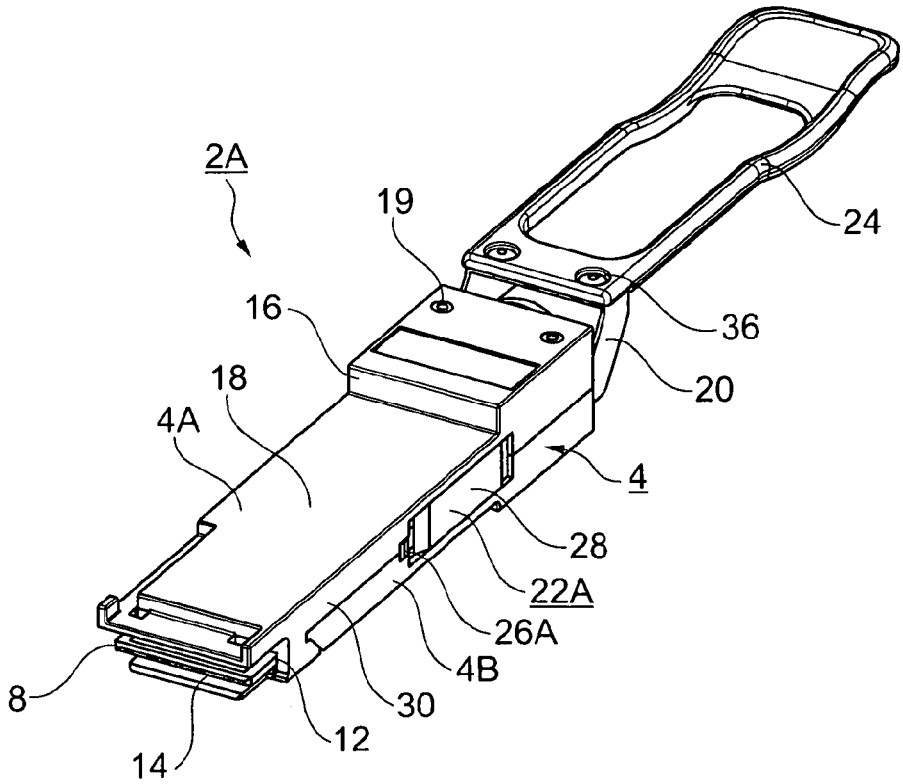
FIG. 1 is a diagrammatic, perspective view of a QSFP connector element according to the invention.

In the figures, equivalent parts are provided with the same designations. Referring now to the figures of the drawing in detail and first, particularly, to FIGS. 1 and 2 thereof, there are shown different types of connector elements 2A, 2B, that is to say a QSFP connector element 2A (FIG. 1) and an SFP connector element 2B (FIG. 2), each have a two-shell part connector housing 4 with an upper part 4A and a lower part 4B. The connector elements 2A, 2B extend in a longitudinal direction between a rear end wall 6 and a front end side 8. A cable opening 10 for a cable which is to be introduced is formed on the rear end wall 6. The front end side 8 has an opening 12 for a plug-in contact element formed by a printed circuit board 14. In the rear region, the connector housings 4 each have a housing step 16, as a result of which the height, but not the width, of the connector is reduced. The front region, which adjoins the housing step 16, forms a connector region 18, by which the connector element 2A, 2B, in the plugged-in state, is plugged in a corresponding counterpart for contact purposes. The two housing parts 4A, 4B are preferably connected exclusively in the rear region via fastening rivets 19.

A respective installation part 20 of a locking element 22A, B, which runs, at least in part, in the interior of the connector housing 4, passes out of rear end wall 6. A pull tab 24 is fastened on the installation part 20, and can be actuated merely in the longitudinal direction, no rotary movement being possible.

The locking element 22A, 22B has a respective catch element 26A, 26B, which is configured in the manner of a projecting nose.

In the case of the QSFP connector element 2A, the locking element 22A contains two lateral, longitudinally running locking arms 28, or is formed thereby, the catch element 26A being formed at the end of the same. The locking arms 28 are sheet-metal tabs guided in a respective side wall 30 of the connector housing 4.

In contrast to this, the catch element 22B of the SFP connector element 22B is arranged on the upper side of the connector housing 4, in the connector region 18. In the region of a catch element 26B, the connector housing 4 is additionally enclosed by an EMI cage for shielding purposes.

Figure 3:
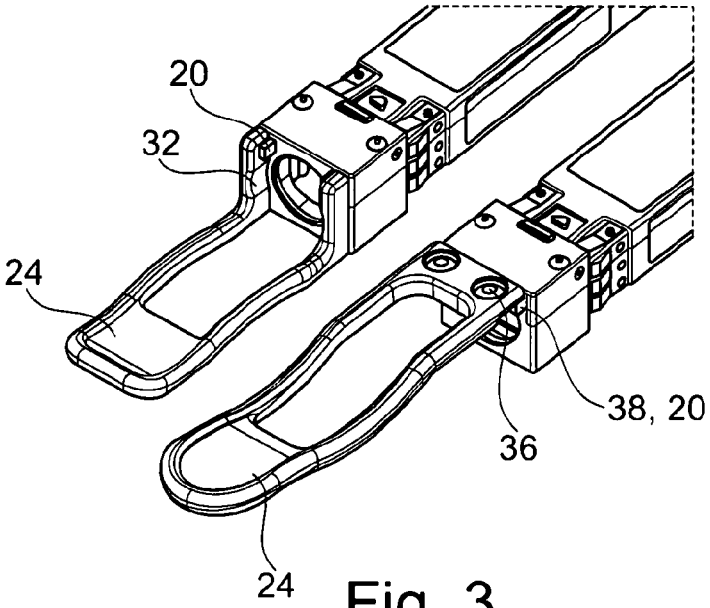
FIG. 3 is a diagrammatic, perspective view showing two different variants of the fastening of the pull tab, that is to say a molded-on pull tab (left-hand half of FIG. 3) and a riveted-on pull tab (right-hand half of FIG. 3) using the example of the SFP connector element.

FIGS. 3, 4, 5A and 5B will be used herein below to describe various possible ways of fastening the pull tab 24. FIG. 3 illustrates two basically different variants. The left-hand half of FIG. 3 shows a variant in which the pull tab 24 has vertical arms 32, by which it is fastened on corresponding installation legs 34 (see FIG. 4) of the installation part 20. In the case of the second variant, the pull tab 24 is fastened on a transverse bracket 38, which forms the projecting installation part 20, via rivets 36.

Of particular note here is the variant with the molded-on pull tab 24, in particular with the approximately L-shaped configuration thereof, which is formed by the vertical arms 32 and adjoining, essentially longitudinally extending lateral arms, which engage around a gripping chamber. In the rear region, a marking panel, for example for applying a brand name, is formed between the lateral arms. The particular advantage of this approximately L-shaped configuration in conjunction with the molding possibility can be seen in the fact that client-specific production can take place and the pull tab 24 can be readily arranged above or also beneath a cable which is to be introduced. Rotation through 180° is rendered possible in this respect.

In the case of SFP variant (FIG. 4), the installation part is formed, internally, approximately as a U-shaped bracket, with the installation legs extending in the vertical direction on the outside. The bracket of the insulation part 20 here forms a transverse strut 40, which can be used to actuate a rocker 42, which has the catch element 26B. The transverse strut 40 here is oriented in the transverse direction transverse to the longitudinal direction and also transverse to the vertical direction, in which, for example, the installation legs 34 extend.

The longitudinal direction is generally the direction of extent from the rear end wall 6 to the front end side 8, the transverse direction is the direction of extent perpendicular thereto, from the left-hand to the right-hand side wall 30 (width), and the vertical direction is the direction of extent perpendicular to the longitudinal direction and the transverse direction, from the underside of the housing to the upper side of the housing (height).

Figure 4:
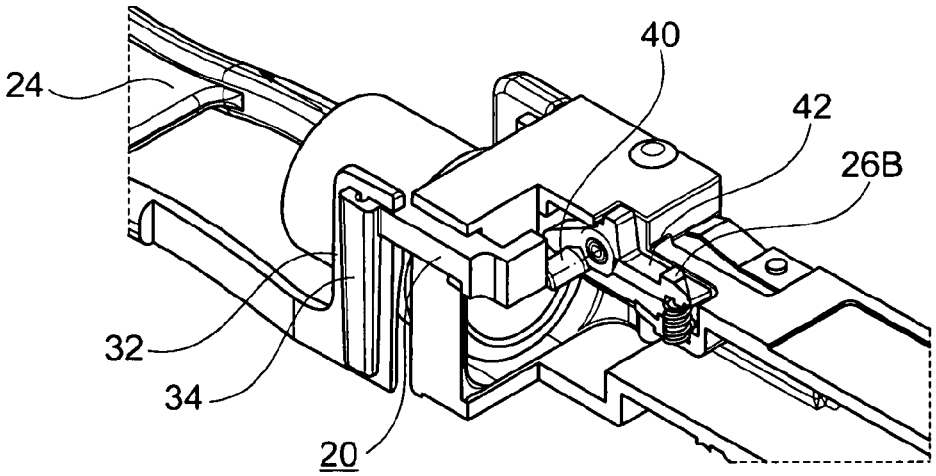
FIG. 4 is a diagrammatic, perspective view of the SFP connector element in a detail-form, partial elevation in order to explain more specifically the variant shown in FIG. 3 with the molded-on pull tab.
Figure 5A:
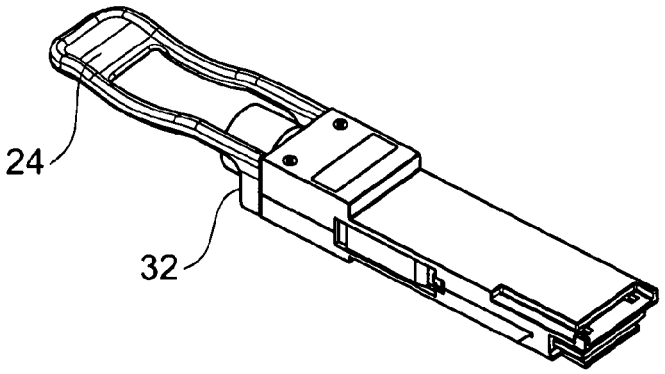
Figure 5B:
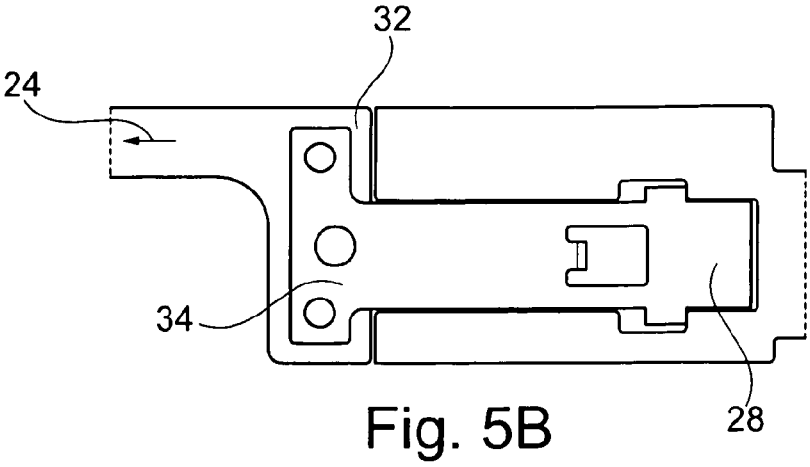
FIG. 5B is a detail-formed sectional view of the connector element illustrated in FIG. 5A, this time in the region of the molded-on pull tab.

For form-fitting fastening of the molded-on pull tab 24, the insulation part 20 has, for example, undercuts, openings etc. in the molded-on region, as can be gathered from FIG. 4 or also from FIG. 5B.

Figure 6:
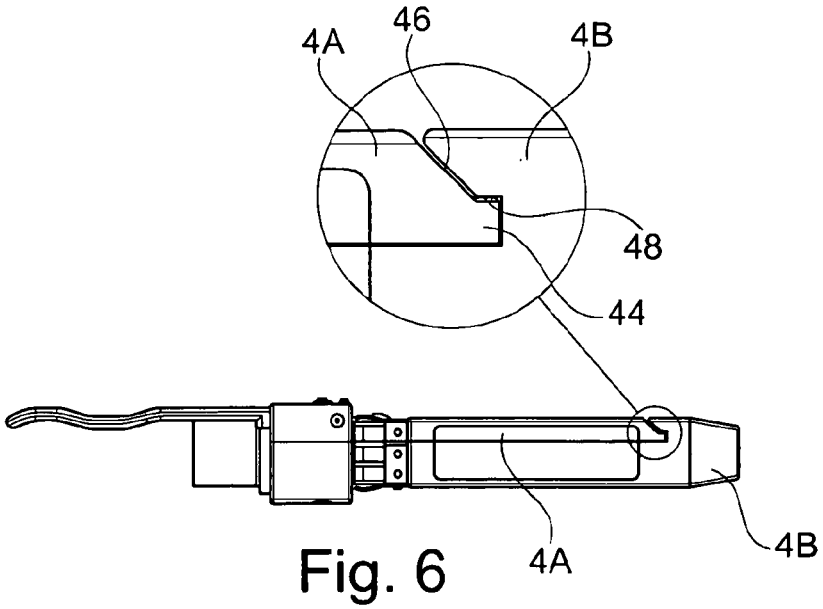
FIG. 6 is a side view of the SFP connector element in order to explain the step-like play-free connection between the two housing parts, the connecting region being illustrated on an enlarged scale.

The next thing, then, is to use FIG. 6 to explain more specifically the aspect of the step-like, play-free connection between the two housing parts 4A, 4B. The upper part 4A, on the front end of each of its opposite side walls, has a nose 44, which extends (horizontally) in the longitudinal direction and is adjoined at an obtuse angle, in the direction of the upper side of the housing, by an installation slope 46. Correspondingly, the lower part 4B of the housing is provided with a recess 48, in which the nose 44 engages. An installation slope 46 is likewise formed on the lower part 4B. The two housings parts 4A, 4B are located in the play-free manner one inside the other in this front region, and a snug fit is therefore formed. The two housing parts are thus fastened on one another in a play-free manner in the vertical direction.

Figure 7A:
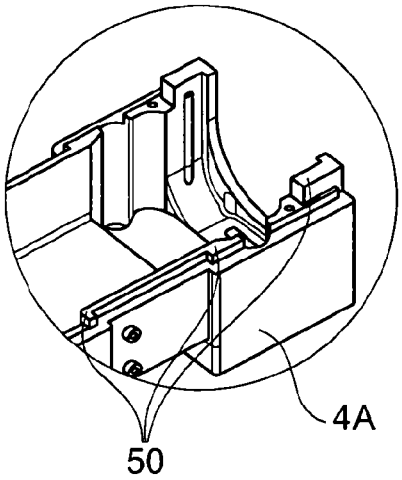
FIG. 7A is a diagrammatic, perspective view of a lower part of the housing in the rear region, with a cable opening, in order to illustrate the form-fitting connection between the two housing parts in the manner of meshing in the rear sub-region.
Figure 7B:
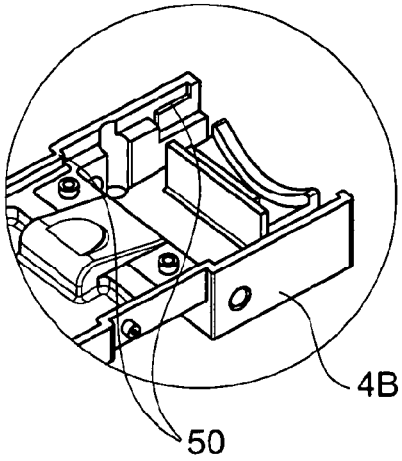
FIG. 7B is a diagrammatic, perspective view of the corresponding upper part of the connector housing.

In order also to achieve a play-free fit with the two housing parts 4A, 4B in the horizontal direction, that is to say in the longitudinal direction, a longitudinally acting form-fitting connection is also formed, in addition, in the rear region of the two housing parts 4A, 4B (FIGS. 7A and 7B). For this purpose, set-back housing portions 50 are provided on the housing parts 4A, 4B in order to form a kind of meshing. In particular in combination with the step-like configuration, as is illustrated in FIG. 6, this makes it possible for the two housing parts 4A, 4B to be fastened reliably on one another. Installation here takes place such that in the first instance the upper housing part 4A is plugged at least in part, with the nose 44 in front, into the corresponding recess 48, to be precise it is oriented obliquely in relation to the longitudinal direction and then pivoted in until the set-back housing portions 50 engage one inside the other in the rear region. The meshing in the rear region therefore means that it is not possible for the two housing parts 4A, 4B to be displaced parallel in the longitudinal direction for installation purposes. Rather, pivoting is necessary.

Figure 8A:
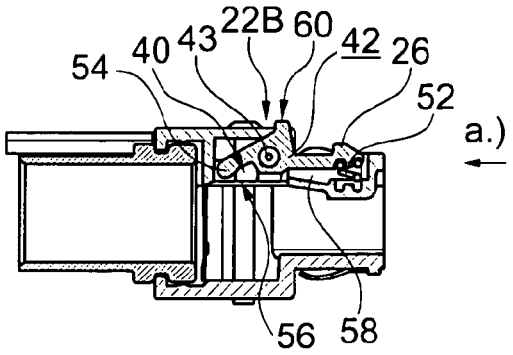
FIG. 8A is a sectional view of the SFP connector element in order to explain an unlocking mechanism with an emergency unlocking function.
Figure 8B:
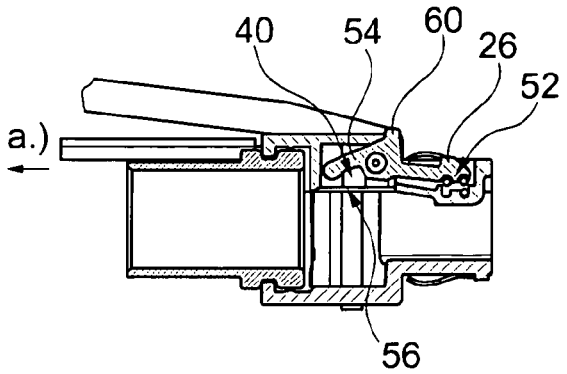
FIG. 8B is a sectional view according to FIG. 8A together with a tool in the event of emergency unlocking.

The next thing, then, is to use FIGS. 8A and 8B to explain the aspect of emergency unlocking in the case of the SFP connector element 2A and also the functioning of the locking element 22B.

Figure 9:
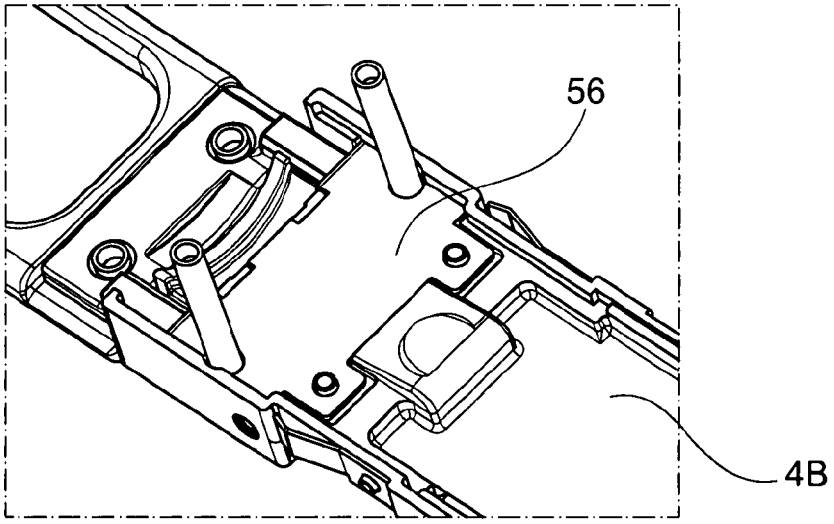

As has already been described in relation to FIG. 4, the locking element 22B has the rocker 42, which is mounted on a rotary pin 43. The catch element 26B is formed on the front end region of the rocker 42. The front end of the rocker 42, furthermore, is pushed upward into a basic position by a spring element 52. This basic position corresponds to a locking position. In the rear region, the rocker 42 has a rear rocker arm 54, which, at least on its underside, has an actuating slope, with which the transverse strut 40 of the installation part 20 is in contact. The rear rocker arm 54 is supported in the downward direction on a shielding plate 56 which, together with the housing-part regions, bounds, and closes off, an accommodating chamber 58 in the downward direction. The shielding plate 56 serves, in particular, also for EMC shielding and is also illustrated in FIG. 9. It is riveted to the upper part 4B of the housing.

With the aid of the pull tab 24, the locking element 22B is transferred out of the basic position (locked position), which is illustrated in FIG. 8A, into the unlocked position, which is illustrated in FIG. 8B. For this purpose, the pull tab 24 is pulled longitudinally in the rearward direction, and therefore the transverse strut 40 slides along the slope of the rocker arm 54 and thus generates the rocking movement, in which case the front rocker arm with the catch element 26B is pushed downward counter to the spring force.

The rocker 42, as a special feature, has an actuating element 60 formed in the manner of a transverse crosspiece for emergency actuation with the aid of a tool 62. The actuating element 60 is formed on the rocker 42 and extends beyond the upper side of the housing, in which case it is freely accessible from the outside. The rocker 42 can be transferred into the unlocked position by being pushed forward.

FIGS. 10 to 13 will now be used to explain the function of the QSFP connector element 2A and the special aspect of spring 64, which is retained in captive fashion.

Figure 10:
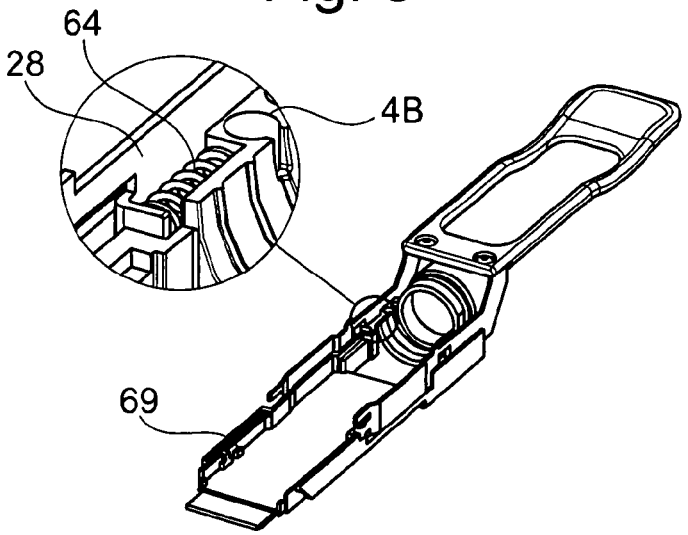
FIG. 10 is a perspective view of the lower part of the housing of the QSFP connector element with the locking element inserted and the pull tab fastened thereon, the region of the spring element being illustrated on an enlarged scale.
Figure 11:
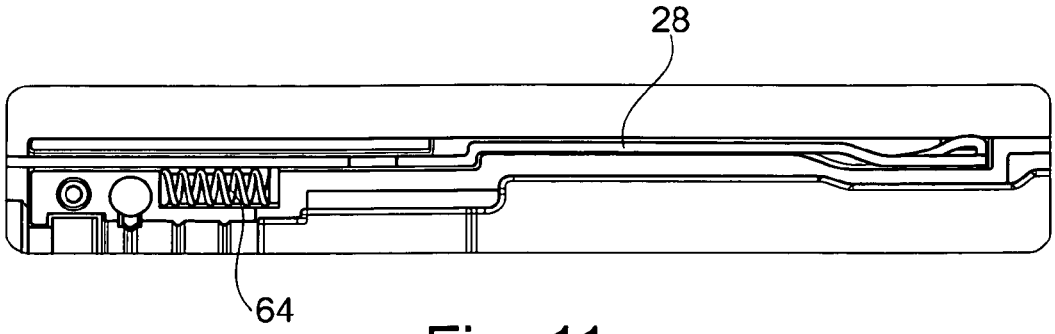
FIG. 11 is a plan view of a wall of the connector illustrated in FIG. 10.
Figure 12A:
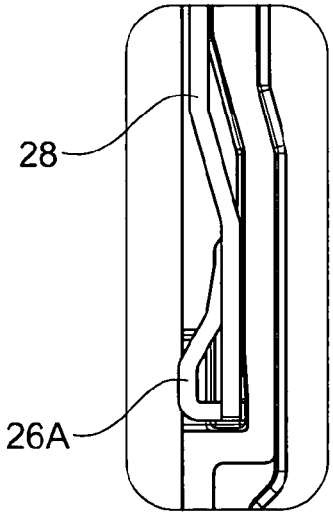
FIG. 12A is an enlarged plan view of the illustration of FIG. 11 in a region of a catch element at an end of the locking arms in a locking position.
Figure 12B:
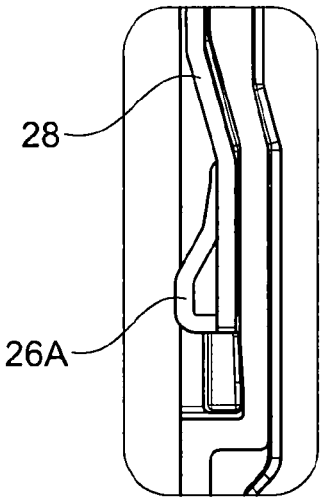
FIG. 12B is a plan view which is comparable to FIG. 12A, but with the locking arm in an unlocked position.
Figure 13:
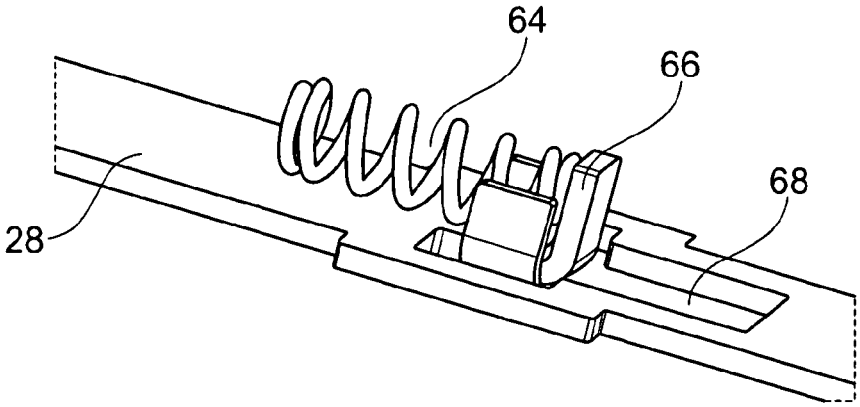
FIG. 13 is a perspective view of one of the locking arms of the QSFP connector element with a spring pre-installed thereon, in captive fashion.

The lateral locking arms 28 are guided inside the rear region of the side walls 30 of the housing, the housing itself forming a guide here. As is illustrated in FIG. 10, in the rear region, a spring 64, configured in the form of a helical spring, is fastened in captive fashion on a respective locking arm 28. The spring 64 here extends in the longitudinal direction and presses the locking arms into a basic position, as is also illustrated, in particular, in FIG. 12A. In the front region, the locking arms 28 are each angled some way inward. The catch elements 26B are arranged, on the outside, in the angled sub-region. In a manner corresponding to the angled portion, it is also the case that a wall region of the housing 4 is configured to slope. In order to lock the connector, a catch tab of the counterpart engages, in a manner which is not illustrated specifically here, in the side wall 30. For unlocking purposes, the catch tab is pushed away laterally outward with the aid of the catch element 26A, in which case the connector element 2A can be drawn out. This takes place by virtue of the pull tab being subjected to pulling action, in which case the locking arm 28 is pulled in the rearward direction, as is illustrated in FIG. 12B. The catch element 26A here is pushed laterally outward by the sloping wall region and thus unlocks the catch tab.

In order for the spring 64 to be retained in captive fashion, a sheet-metal tab 66 is punched out of the locking arm 28 and bent over. As can be seen from FIG. 13, the locking arm 28, for this purpose, has an approximately T-shaped punched-out portion 68 and the sheet-metal tab 66 contains three sub-tabs, each bent over approximately through 90° to form a cage-like clamping mount, in which the spring 64 is accommodated.

A further aspect can be gathered from FIG. 10. The printed circuit board 14 accommodated in the connector housing 4 in the definitively installed state (see for example, FIG. 1) is preferably retained in the connector housing 4 exclusively with clamping action by way of protuberances 69 preferably formed on the periphery with both housing parts 4A, 4B. The protuberances 69 are formed preferably on the periphery of a respective housing base of the upper part 4A and lower part 4B. They are thus expediently formed both in the upper part 4A and in the lower part 4B, and therefore the printed circuit board 14 is preferably clamped on the housing parts 4A, 4B by the protuberances 65 in a play-free manner both in the transverse direction and in the vertical direction.

Figure 14A:
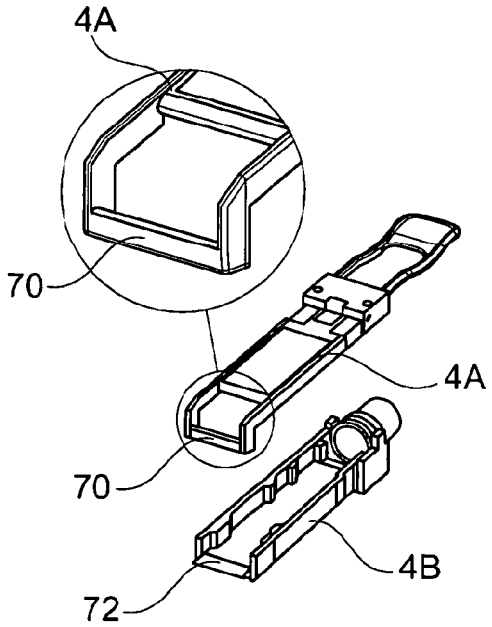
FIG. 14A is an exploded, perspective view of a lower part of the housing and an upper part of the housing in a further variant, in which the upper part of the housing has an angled bracket on its front end side, an angled front region also being illustrated on an enlarged scale.
Figure 14B:
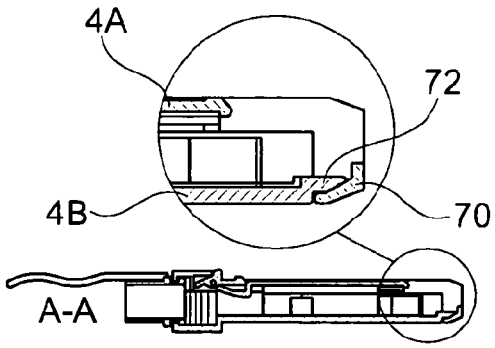
FIG. 14B is a side view of the connector element illustrated in FIG. 14A, this time in the installed position, with the front end region being illustrated on an enlarged scale.
Figure 15:
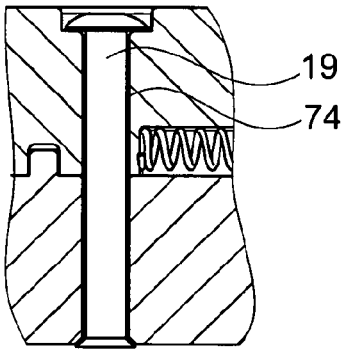
FIG. 15 is a sectional view in a region of a fastening rivet for riveting the two housing parts.

FIGS. 14A and 14B will now be used to explain more specifically a further variant for connecting the two housing parts 4A, 4B. The upper part 4A, on its front end side 8, has a transverse bracket 70, which is angled approximately vertically downward. The transverse bracket is connected to an upper side of the housing via two lateral vertical arms and lateral horizontal arms adjoining the same. This design creates an end opening, through which the printed circuit board 14 can project on the end side. The upper part 4A uses the transverse bracket 70 to engage behind a corresponding transverse tab 72 of the lower part 4B. The mutually corresponding abutment surfaces of the transverse bracket 70 on the transverse tab at the end of the lower part 4B slope in relation to the horizontal, in order to make easy installation possible. As can be gathered, in particular, from FIG. 14B, a horizontally running nosepiece is formed at the end of the slope of the transverse bracket 70, and the nosepiece fits on a shoulder on the transverse tab 72. The slope means that the two housing parts 4A, 4B are retained on one another in a play-free manner.

Figure 2:
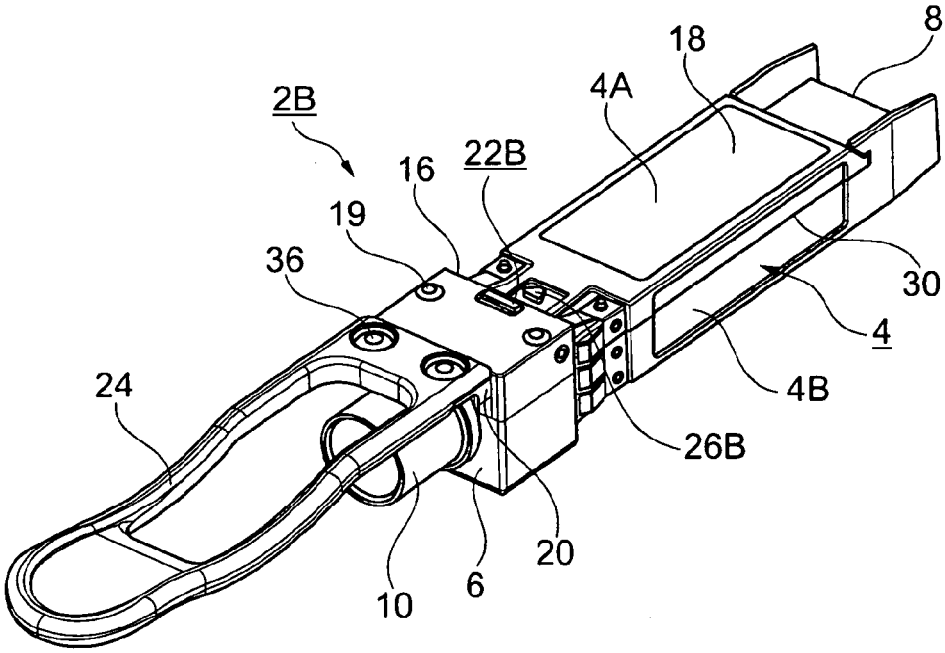
FIG. 2 is a diagrammatic, perspective view of an SFP connector element according to the invention.

As already illustrated in FIGS. 1 and 2, the two housing parts 4A, 4B are preferably fastened on one another exclusively in the rear region by two fastening rivets 19, which extend in the vertical direction through the two housing parts. With the exception of the form-fitting housing connections, there are no further rivet fastenings or other fastening means provided in the front connector region 18. In order to form a rivet connection which is as reliable and free of play as possible, the two housing parts 4A, 4B have formed in them aligned through-passages for the formation of a rivet guide 74. The latter is provided with a larger diameter in the center region than at its opposite ends. It thus has its smallest diameter at its two opposite ends, that is to say at the entry or exit openings on the housing. The fastening rivet 19 is retained in a play-free manner at said entry or exit openings. The widening in the center at the same time makes easy introduction possible.

The invention claimed is:

1. A connector element being a flat connector for data lines in networks, the connecting element comprising:

a connector housing extending in a longitudinal direction and having two housing parts, including an upper housing part and a lower housing part, said connector housing having a rear end wall with a cable opening formed therein for a cable which is to be connected and a front connector region forming a housing step and having an opening formed therein on a front end side for a plug-in contact element;

a locking element disposed, at least in part, within said connector housing;

a locking mechanism for forming a lockable plug-in connection to a counterpart, said locking mechanism having a longitudinally movable pull tab, disposed outside said connector housing and connected in a rotationally fixed manner to said locking element; and said locking element having a catch element for a form-fitting unlocking and locking of the connector element in relation to the counterpart and, when said pull tab is subjected to pulling action, said catch element can be transferred out of a locking position into an open position, said locking element containing a rocker which can be tilted about a horizontal axis of rotation and having said catch element at a front end and also having an actuating element projecting beyond an upper side of said connector housing and accessible to a tool for emergency actuation of said rocker when the connector element has been plugged in place.

2. The connector element according to claim 1, further comprising a rear installation part, and by said rear installation part, said locking element is guided out of said connector housing via said rear end wall and fastened in a non-releasable manner on said pull tab; and wherein said pull tab is a plastic part molded onto said rear installation part.

3. The connector element according to claim 1, wherein:

said rear installation part has installation legs; and said pull tab, as seen in a side view, is of an L-shaped design at least in a region in a vicinity of said connector housing and has two lateral vertical arms, which are fastened on said installation legs of said rear installation part.

4. The connector element according claim 1, wherein said rear installation part has a transverse bracket, on which said pull tab is fastened.

5. The connector element according to claim 1, wherein said pull tab can be installed in a state in which said pull tab is offset by rotation through 180° in relation to the longitudinal direction.

6. The connector element according to claim 1, wherein said upper housing part and said lower housing part, in said front connector region engage one inside the other in a step-like manner for a play-free connection and have corresponding installation slopes, which allow said upper and lower housing parts to pivot in relation to one another for installation purposes.

7. The connector element according to claim 6, wherein:

said upper housing part contains side walls each with an end side having a nose, which extends parallel to the longitudinal direction and has an adjoining upper installation slope; and said lower housing part, to complement said nose, has a recess formed therein with an adjoining lower installation slope.

8. The connector element according to claim 6, wherein said upper and lower housing parts are meshed in a form-fitting manner with one another in the longitudinal direction at a rear end, so as to prevent horizontal displacement.

9. The connector element according to claim 1, wherein said catch element, upon actuation of said rocker from a locking position to an unlocking position, is drawn in inward in a direction of an interior of said connector housing.

10. The connector element according to claim 1, wherein:

said locking element has a first spring element; and said rocker, in a front region, is mounted against said first spring element, which extends in a vertical direction and perpendicularly to an axis of rotation of said rocker.

11. The connector element according to claim 1, wherein said locking element has a rotary pin and said rocker is mounted in a rotatable manner on said rotary pin.

12. The connector element according to claim 1, wherein said connector housing defines an accommodating chamber;

further comprising a shielding plate attached to said connector housing; and wherein said rocker is disposed within said connector housing, in said accommodating chamber which is closed off in relation to a housing interior by said shielding plate.

13. The connector element according to claim 1, wherein said upper housing part, on said front end side, has a transverse bracket, which is angled in a direction of said lower housing part and engages around said lower housing part.

14. The connector element according to claim 1, wherein said upper and lower housing parts each have a rivet guide formed therein of a given diameter, for receiving a rivet for rivet fastening of said upper and lower housing parts on one another.

15. The connector element according to claim 1, wherein said connector housing has an interior with peripheral protuberances for play-free fixing of the plug-in contact element, and the plug-in contact element is a printed circuit board.

* * * * *